United States Patent [19]

Bisbing

[11] Patent Number: 4,687,237

[45] Date of Patent: Aug. 18, 1987

[54] OVER-CENTER TOGGLE LATCH

[75] Inventor: Robert H. Bisbing, Springfield, Pa.

[73] Assignee: Southco, Inc., Concordville, Pa.

[21] Appl. No.: 857,964

[22] Filed: May 1, 1986

[51] Int. Cl.[4] ..... E05C 3/22

[52] U.S. Cl. ..... 292/78; 292/DIG. 49

[58] Field of Search ..... 292/78, 79, 304, DIG. 49, 292/DIG. 46, DIG. 72, 216

[56] References Cited

U.S. PATENT DOCUMENTS

| | | | |
|---|---|---|---|
| 2,355,895 | 8/1944 | Roberts | 292/78 |
| 2,584,903 | 2/1952 | Miller | 292/264 |
| 2,901,277 | 8/1959 | Anderson | 292/78 |
| 2,923,145 | 2/1960 | Labrie | 292/DIG. 46 X |
| 3,040,555 | 6/1962 | Wartian | 292/DIG. 46 X |
| 3,659,886 | 5/1972 | Andrews | 292/DIG. 49 X |
| 3,713,681 | 1/1973 | Worley | 292/78 |
| 3,905,626 | 9/1975 | Myers | 292/78 X |
| 4,210,349 | 7/1980 | Cook et al. | 292/78 |

*Primary Examiner*—Richard E. Moore
*Attorney, Agent, or Firm*—Paul & Paul

[57] ABSTRACT

An over center toggle latch for holding a door closed against a surface of a receiving structure comprises a latch housing adapted to be mounted on the receiving structure, a toggle member pivotally mounted within the housing for pivotal movement between a latched and unlatched position, a keeper mounted on the door having a dog projection adapted to be received within the housing when the toggle member is in the unlatched position and retained therein when the toggle member is in the latched position, and a pair of guide members in sliding telescopic arrangement, outwardly urged apart by a spring, for retaining the toggle member in the latched or unlatched positions, and for holding the door closed by a predetermined amount of force.

6 Claims, 7 Drawing Figures

OVER-CENTER TOGGLE LATCH

BACKGROUND OF THE INVENTION

This invention relates generally to latches and more specifically to latches of the over center toggle type.

Over center toggle latches are generally known in the art. These known latches, however, are often large in size and cumbersome, thus reducing their overall utility. Typically, these known latches also comprise a number of separate pieces in complex arrangement and are thus costly to manufacture and time-consuming to assemble.

A further disadvantage of these known toggle-type latches is that they often do not provide for holding the door closed with a specific force or for readily changing the amount of force with which the door is held closed.

SUMMARY OF THE INVENTION

Accordingly, it is an object of the present invention to overcome the above-mentioned disadvantages by providing an over center toggle latch which is small and simple in construction, thus reducing costs of manufacture and time for assembly.

It is a further object of the invention to provide an over center toggle latch which is designed to hold a door closed with a specific force.

It is still another object of the invention to provide an over center toggle latch in which the force used to hold the door closed can be readily changed, if desired.

These and other objects of the invention, which will become apparent upon a reading of the following description with reference to the drawings and the appended claims, are achieved by providing an over center toggle latch which comprises a latch housing adapted for being affixed to a door-receiving structure, keeper means adapted for being affixed to a door and having a dog projection adapted to be retained within the housing when the door is in the closed position, a toggle member pivotally movable within said housing between a first position to receive said dog projection of said keeper means, and a second position wherein said toggle member overlaps said dog projection of said keeper means, and retaining means positioned within said housing and cooperating with said toggle member for retaining said toggle member in said first receiving position and said second position wherein said door is retained in the closed position against a surface of the receiving structure.

DETAILED DESCRIPTION OF THE EMBODIMENTS

Figure 2:
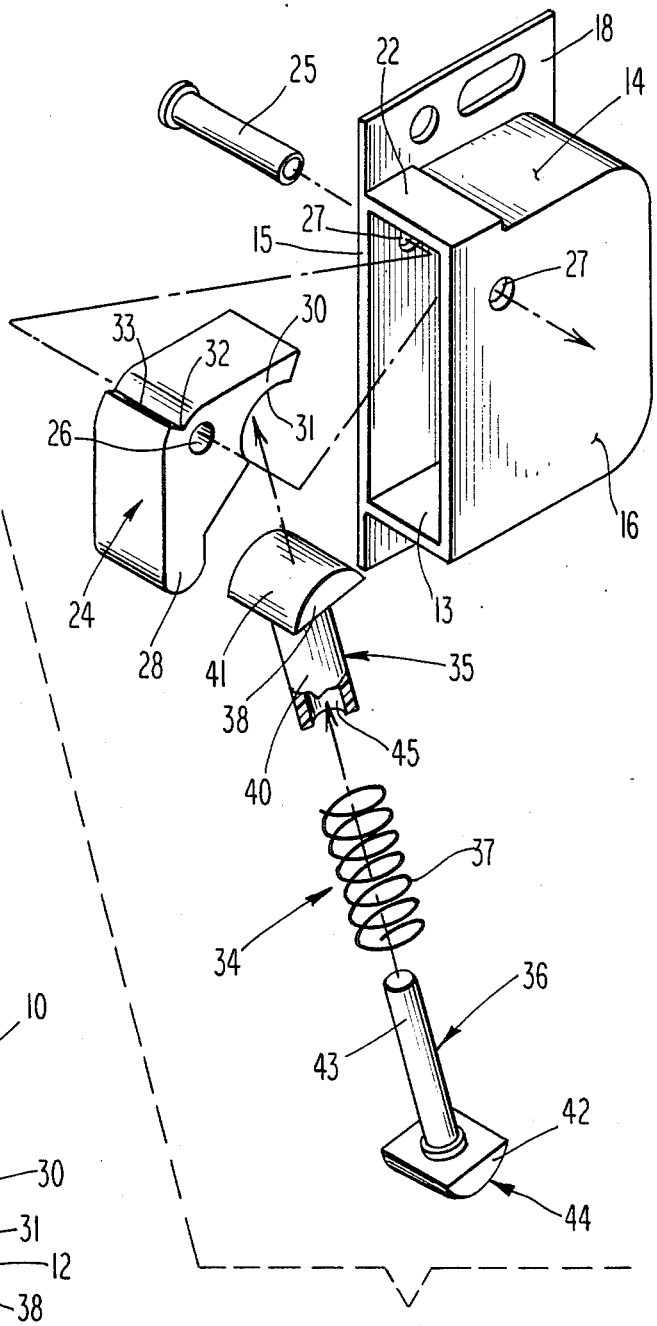
FIG. 2 is an exploded perspective view of the embodiment of FIG. 1.
Figure 1:
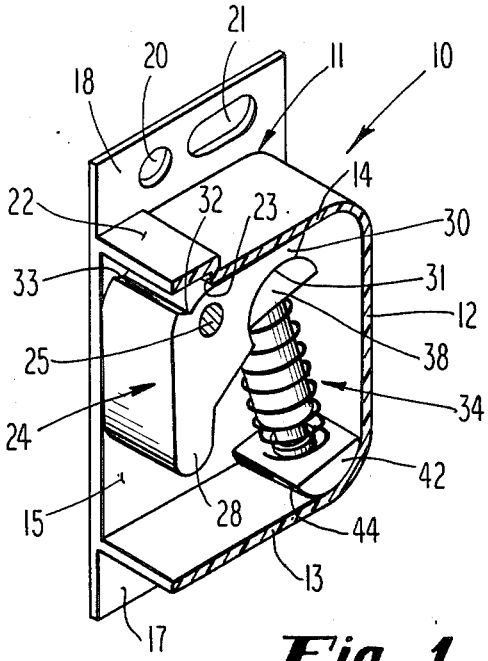
FIG. 1 is a perspective view of one embodiment of the latch in accordance with the invention, partially broken away to show detail.

The invention will now be described in detail with reference to the drawings, reference first being made to the embodiment in FIGS. 1 and 2 wherein the over center toggle latch, generally designated as 10, comprises a housing 11 having a back wall 12 and side walls 13 and 14. The housing 11 also is provided with bottom wall 15 and top wall 16 (see FIG. 2). Projecting from the side walls 13,14 at the bottom thereof, are mounting flanges 17,18 which are provided with mounting openings, such as aperture 20 or slot 21 of flange 18, for facilitating the mounting of the housing to a door-receiving structure. As seen in FIG. 1, side wall 14 is provided with a shelf portion 22 which forms shoulder 23 at an interior portion of wall 14, the function of which is more fully described hereinafter.

Toggle member 24 is pivotally mounted within housing 11 by pivot pin 25 which extends through aperture 26 in toggle member 24 and apertures 27,27 in bottom and top walls 15,16 of housing 11. The pivotal movement of toggle member 24 about pin 25 is perhaps best seen in FIGS. 4–7.

As seen in the Figures, toggle member 24 is an irregular shaped member having a latch projection 28 and a leg 30 extending at generally right angles to one another from the aperture 26. Leg 30 is provided with a concave portion 31 on its interior surface, the function of which will be described more fully hereinafter. Toggle member 24 is notched on its external surface as at 32 to form ear projection 33 which cooperates with shoulder 23 of wall 14 and functions as a stop in the pivotal movement of the toggle member 24 when the toggle member is in the open, unlatched position. (See FIG. 4)

Figure 4:
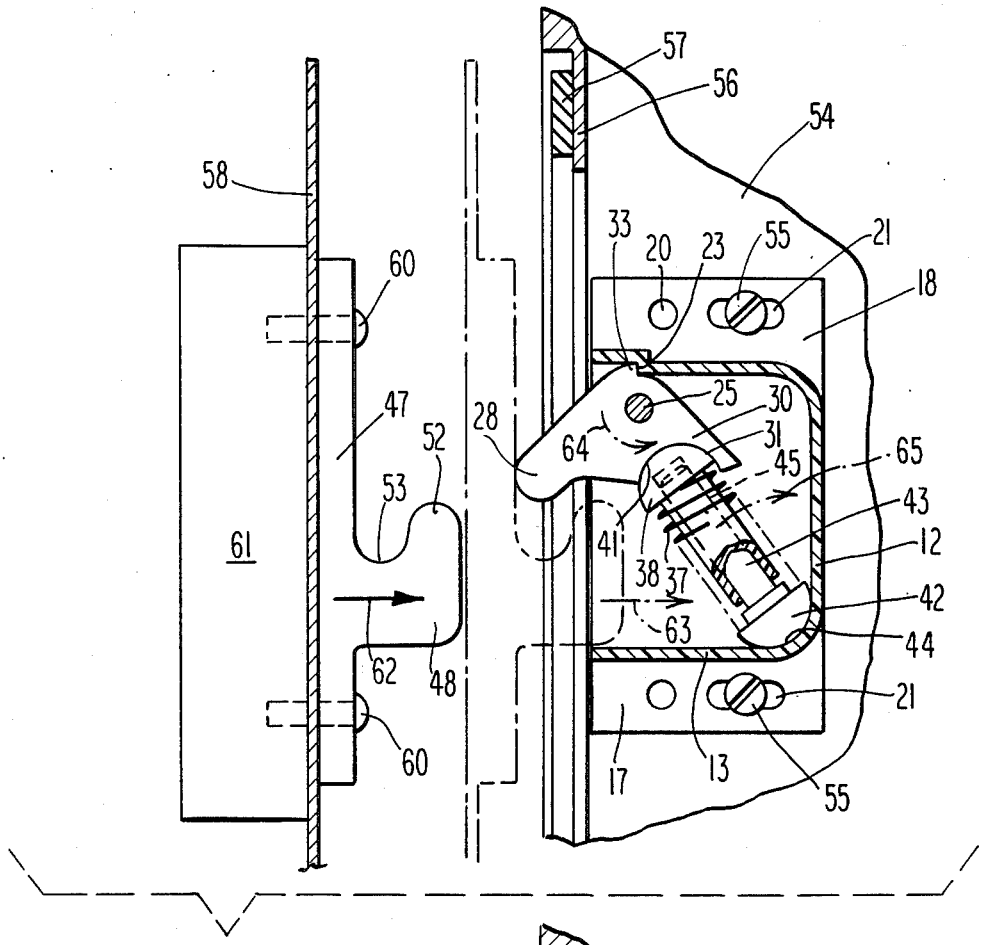
FIG. 4 is a sectional view of one embodiment of the invention as mounted to a door and cabinet structure with the door being in an open position and the latch being in an unlatched condition.
Figure 5:
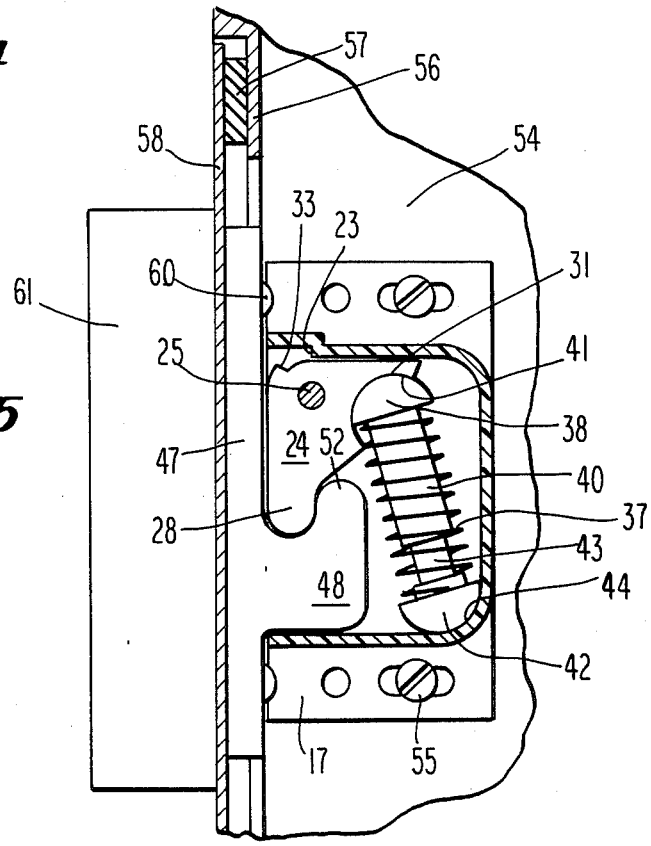
FIG. 5 is a sectional view of the mounted invention similar to that of FIG. 4, wherein the door is in the closed position and the latch is in a latched condition.

Retaining means, generally designated as 34, is also provided within housing 11 to retain the toggle member 24 in the open or closed positions, as illustrated in FIGS. 4 and 5, respectively. The retaining means 34 comprises a pair of guide members 35,36 and a spring 37. Guide member 35 comprises a head portion 38 and a sleeve portion 40, which head portion 38 has a convex surface 41 adapted to be received in concave portion 31 of leg 30 of toggle member 24.

Guide member 36 comprises a head portion 42 and a rod portion 43, which head portion 42 is also provided with a convex surface 44 adapted to be received in the corner formed by side wall 13 and back wall 12 of housing 11. Sleeve portion 40 of guide member 35 is provided with bore 45 sized to closely receive rod portion 43 of guide member 36 for sliding telescopic engagement therewith. Spring 37 is sized so as to be received between head portions 38,42 of guide members 35,36 when rod portion 43 is positioned within bore 45 of sleeve portion 40, and urges head portions 38,42 apart when positioned within housing 11.

Figure 3:
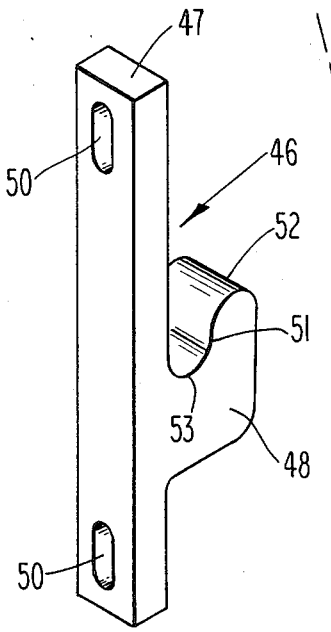
FIG. 3 is a perspective view of one embodiment of the latch keeper in accordance with the invention.

Referring now to the embodiment of FIG. 3, illustrated therein is keeper 46 having a base portion 47 and a dog projection 48 extending therefrom. Base portion 47 is provided with mounting apertures, such as slots 50,50 to facilitate the mounting of keeper 46 on a door. As seen in FIG. 3, dog projection 48 is generally "L"-shaped and extends outwardly and then upwardly from base portion 47 of keeper 46. The shape of dog projection 48 is such as to form an "S"-shaped inner surface 51 having a convex portion 52 and a concave portion 53, which concave portion 53 is adapted to receive latch projection 28 of toggle member 24 when toggle member 24 is in the closed position as in FIG. 5, so that latch projection 28 overlaps convex portion 52 of dog projection 48 when the toggle member 24 is in the closed position.

The operation of the over center toggle latch of the present invention will now be described more fully with reference to FIGS. 4 and 5. As illustrated in the Figures, the latch housing is mounted on a door-receiving structure, such as cabinet 54, by screws 55 or other conventional means, through slots 21,21 in flanges 17,18. Cabinet 54 has a door-receiving surface 56 which may be provided with a gasket, such as gasket 57, if desired. Keeper 46 is shown attached to door 58 such as by screws 60 extending through mounting slots 50 of base portion 47 and connected to door handle 61.

From the open, unlatched position illustrated in FIG. 4, door 58 is moved toward cabinet 54, in the direction of arrow 62 until keeper base 47 comes in contact with latch projection 28 of the toggle member 24 which, in the open position, is extending from the housing 11, as shown. That is, keeper 46 reaches the position illustrated in FIG. 4 in broken lines. As can be seen in FIG. 4, in the broken line position, dog projection 48 of keeper 46 is received within housing 11. Further movement of door 58 toward cabinet 54, in the direction of arrow 63, causes toggle member 24 to pivot in the direction of arrow 64, which in turn causes retaining means 34 to pivot in the direction of arrow 65, whereby the toggle member 24 is snapped into the closed latched position illustrated in FIG. 5.

As can be seen from FIG. 5, when the toggle member has snapped into the closed position, latch projection 28 nests within concave portion 53 and overlaps convex portion 52 of dog projection 48 whereby door 58 is held tightly against gasket 57 on surface 56 of cabinet 54.

Also illustrated in the Figures is the function of retaining means 34. As seen in FIG. 4, when the toggle member is in the open, unlatched position, convex surfaces 41,44 of head portions 38,42 of guide members 35,36, respectively, are urged apart by spring 37 to exert pressure on concave surface 31 of leg 30 and the corner of housing 11 formed by back wall 12 and side wall 13 which, in turn, serves to retain toggle member 24 in the open position. When in the closed, latched position, as illustrated in FIG. 5, toggle member 24 is retained therein, again by the outwardly force generated by spring 37 on head portions 38,42 of guide members 35,36, respectively.

Figure 6:
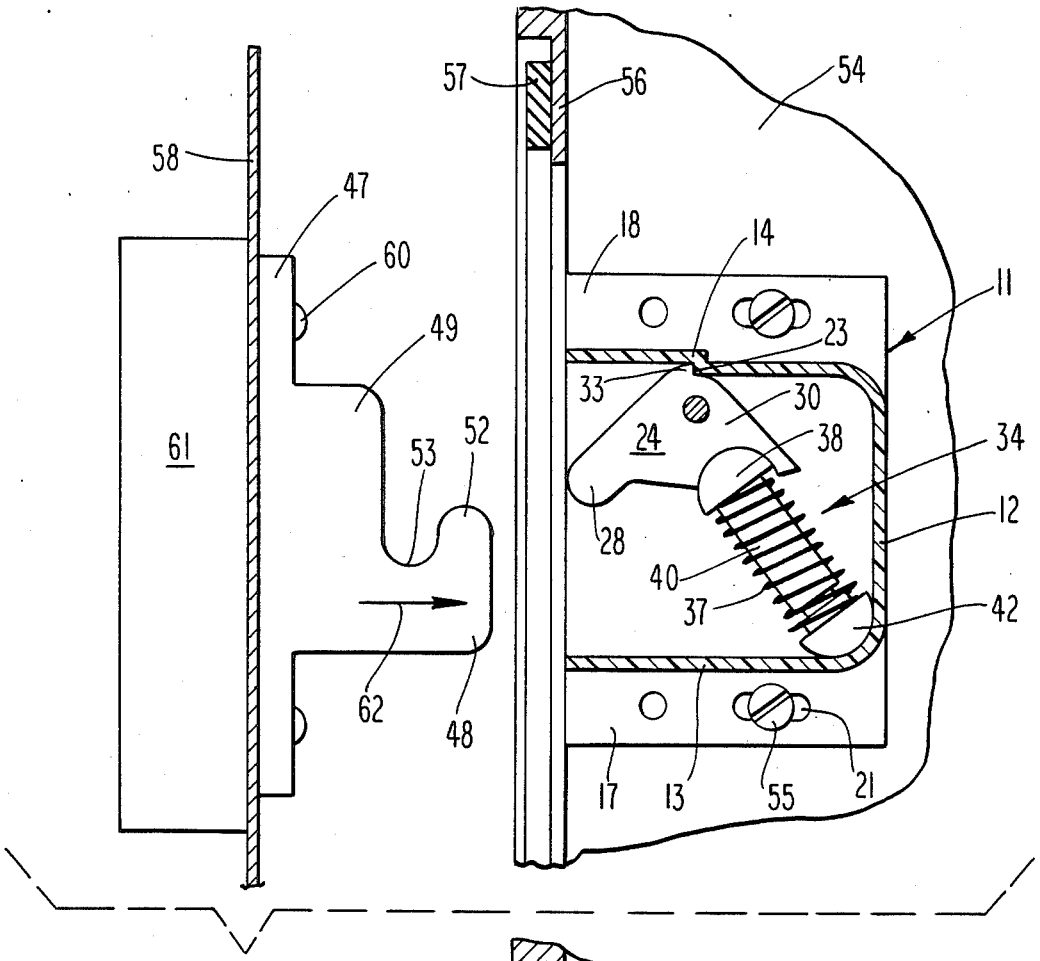
FIG. 6 is a sectional view of a preferred embodiment of the invention as mounted to a door and cabinet structure with the door being in an open position and the latch being in an unlatched condition.
Figure 7:
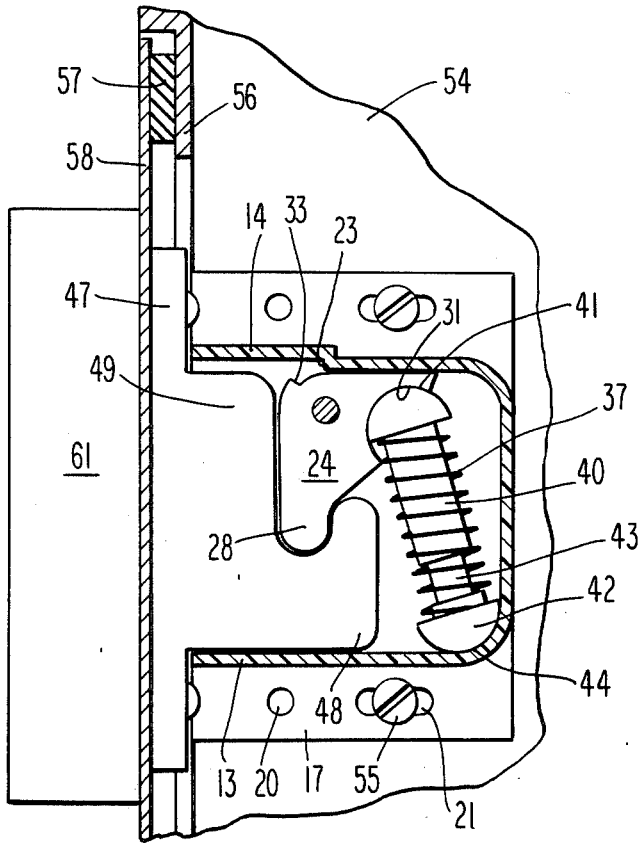
FIG. 7 is a sectional view of the mounted invention as in FIG. 6, wherein the door is in a closed position and the latch is in a latched condition.

In the preferred embodiment of the latch as illustrated in FIGS. 6 and 7, the latch housing 11 has been made deeper by extending side walls 13,14 and bottom and top walls 15,16. As a result, latch projection 28 of toggle member 24 does not extend beyond the housing when the toggle member is in the unlatched position, as seen in FIG. 6. This embodiment is most advantageous because it prevents the possibility of toggle member 24 being struck inadvertently when in the open position, and thereby reduces the incidence of the latch being unintentionally latched closed while the door is still open.

As can be seem from the Figures, the keeper 46 has been modified to compliment the new dimensions of housing 11, and is provided with a step or plateau region 49 between keeper base 47 and dog projection 48. The plateau 49 serves to place the dog projection 48 in the proper position to be retained by toggle member 24 and is sized so as to be received within housing 11 when the latch is in the latched position as shown in FIG. 7. It is to be understood that this particular embodiment of the latch operates in the same manner as the embodiment described above with reference to FIGS. 4 and 5.

As can be seen from the above-described function of the latch, the force by which the door is held against the surface of the receiving structure is a function of the compressive strength of the spring. Thus, the force by which the door is held closed can be readily altered, if desired, by substitution of springs having different compressive properties.

The foregoing disclosure is illustrative of preferred embodiments only and is not to be viewed as a limitation of the invention, and it is to be understood that various modifications or equivalents may suggest themselves, all of which are within the spirit and scope of the invention, the boundaries of which are intended to be defined by the appended claims.

I claim:

1. An over center toggle latch for securing two members together, said latch comprising:

(a) a latch housing adapted for being affixed to one of the members;

(b) a keeper having a base portion adapted for being affixed to the other of the members, and a dog projection connected to said base portion and extending therefrom, said dog projection adapted for being received within said housing and retained therein when the latch is in a closed position;

(c) a toggle member pivotally mounted within said housing for pivotal movement between a first position to receive said dog projection and a second position in overlying disposition to said dog projection and in sandwich orientation to said base portion and said dog projection, whereby said dog projection is retained within said housing;

(d) retaining means disposed within said housing and in pivotal contact with each of said housing and said toggle member for retaining said toggle member in said first and second positions, said retaning means comprising a first guide member having a sleeve portion and a head portion, said head portion having a generally convex outer surface in pivotal sliding engagement with a generally concave surface on said toggle member, a second guide member having a rod portion and a head portion, said rod portion being disposed in sliding telescopic engagement with said sleeve portion of said first guide member, said head portion of said second guide member having a generally convex outer surface in pivotal sliding contact with an inner wall of said housing, and a coil spring disposed about said sleeve portion of said first guide member and contacting said head portions of said first and second guide members, said coil spring comprising means for urging said guide members apart and for urging said head portions into contact with said toggle member and said housing wall;

(e) wherein said base portion of said keeper comprises means for pivoting said toggle member from said first position to said second position upon the closing of said latch;

(f) wherein said dog projection of said keeper comprises means for pivoting said toggle member from said second position to said first position upon the opening of said latch; and (g) wherein said dog projection of said keeper is disposed between said toggle member and said retaining means when said latch is in a closed position.

2. The latch of claim 1, wherein the head portions of said guide members comprise semicylindrical members.

3. The latch of claim 1, wherein said keeper further comprises a step region forming a part of said base portion, said step region being adapted for being received within said housing when said latch is in a closed position.

4. The latch of claim 1, wherein said toggle member is provided with an outwardly projecting ear and wherein said housing is provided with an inwardly extending shoulder on a wall thereof, said ear and said shoulder comprising means for controlling the pivotal movement of said toggle member into the first position.

5. The latch of claim 1, wherein said keeper is affixed to an inside surface of a door, wherein said latch housing is affixed to an inside surface of a receiving structure for the door, and wherein the latch is concealed from view when the door is closed against the receiving structure.

6. The latch of claim 1, wherein said toggle member comprises an angular-shaped member having a pair of legs disposed at substantially right angles to one another, wherein one of said legs is provided with a convex outer edge, and wherein said dog projection of said keeper is substantially L-shaped and is provided with a concave surface adapted to receive said convex edge of said toggle member.

* * * * *